US005464215A

United States Patent [19]

Koehler

[11] Patent Number: 5,464,215

[45] Date of Patent: Nov. 7, 1995

[54] PUTTER HEAD

[75] Inventor: Terry B. Koehler, 145 Deer Hollow, Boerne, Tex. 78006

[73] Assignee: Terry B. Koehler, Boerne, Tex.

[21] Appl. No.: 151,135

[22] Filed: Nov. 12, 1993

[51] Int. Cl.[6] ..... A63B 53/04

[52] U.S. Cl. ..... 273/167 R; 273/169; 273/173

[58] Field of Search ..... 273/167 R, 167 A, 273/167 B, 167 C, 167 D, 167 E, 167 F, 167 G, 167 H, 167 J, 168, 169, 170, 171, 172, 173, 174, 175, 78, 164.1, 194 B

[56] References Cited

U.S. PATENT DOCUMENTS

| | | | |
|---|---|---|---|
| 3,652,093 | 3/1972 | Reuter, Jr. . | |
| 3,872,683 | 10/1980 | Doran et al. . | |
| 4,121,832 | 10/1980 | Ebbing | 273/171 |
| 4,325,553 | 4/1982 | Taylor | 273/167 F |
| 4,508,350 | 4/1985 | Duclos | 273/169 |
| 4,679,792 | 7/1987 | Straza | 273/173 |
| 4,756,535 | 7/1988 | Bradley . | |
| 5,197,737 | 3/1993 | Desbiolles et al. . | |

FOREIGN PATENT DOCUMENTS

| | | | |
|---|---|---|---|
| 2672226 | 8/1992 | France | 273/170 |

*Primary Examiner*—Sebastiano Passaniti
*Attorney, Agent, or Firm*—Gunn, Lee & Miller

[57] ABSTRACT

A putter for striking a golf ball. The putter has a shaft, a grip (a hosel), and a putter head attached to the hosel. The putter head has cavities in the heel and toe portions that are open to the face.

19 Claims, 2 Drawing Sheets

PUTTER HEAD

BACKGROUND OF THE INVENTION

1. Field of the Invention

A putter head, more particularly a putter head having a cavity in the heel portion and a cavity in the toe portion, which cavities open to the face of the golf club.

2. Background Information

Golf is a game of precision—precision in the mechanics of the player attempting to properly swing the golf club, precision in addressing the ball, and also in the equipment he or she chooses. Precision plays an important part in the design of the golf club, where small changes in shape, technical specifications, weight distribution, or the like can result in large differences in the flight or path of the golf ball.

In the design of putters, balance, weight distribution and feel are very important. The intangible qualities of "feel" and "balance" vary from putter to putter, and each designer must rely on his own perception of what is desirable. With regard to weight distribution, however, putting design has evolved in an effort to provide the player with a putter head that will exhibit stability in the forward stroke, and impart as true a roll as possible to the golf ball, even in the incidence of off-center hits.

One feature commonly used in prior art to create stability is offsetting the centerline of the shaft so that it is forward of the face of the putter head. Whether this is achieved through the design of a connecting hosel or a bend in the shaft itself, this offset increases the linear distance between the center line of the shaft and the center of mass of the putter head, thereby increasing the moment of inertia of the putter head and helping the golfer produce a more stable forward stroke. Generally speaking, the greater this measurement, the more stable the putter head will be in the forward stroke, and the more resistant to twist at impact on off-center hits. However, there is a practical limit to which the hosel may be offset and still be visually acceptable to the majority of golfers.

Prior art typically managed the distribution of mass in the putter head solely by shaping the exterior surfaces, but some designs also rely on the use of additional weights, generally of lead or brass. Conventional design also has tended to utilize a hollow cavity to the rear of the putter head behind the central portion of the striking face, which cavity separates weight to the heel and toe areas. Such heel and toe weighting has become accepted and is commonly used as a method of increasing a putter head's pre-impact stability and its resistance to twist at impact on off-center hits. Conventional designs of this type have tended to shape the outside surfaces so that weight is concentrated low and forward of the geometric center of the putter head, thereby giving the putter head a low, forward center of gravity.

In the present invention, the applicant has designed a putter head with additional hollow cavities in the heel and toe areas of the putter head, open from the striking face, which may be left open, covered with a face plate, or filled with a low-density material. That is, applicant has further managed weight distribution in a putter head by creating voids open to the face, in addition to the specific shaping of the exterior surfaces. The resulting removal of mass low and forward in turn concentrates weight to the rear and upward in the putter head, thereby creating a higher and more rearward center of gravity than would be found in a conventional putter head of similar outside dimension and/or weight.

The present invention allows applicant to construct a putter head with an increased moment of inertia for a given set of exterior dimensions and a visually acceptable amount of offset than would be achievable with conventional design art. The result of utilizing applicant's invention is that the putter head thus constructed will exhibit improved stability in the forward stroke and will have greater resistance to twist on off-center impacts with the ball. In addition, applicant's method raises the center of gravity of the putter head to be more directly in line with the center of mass of the golf ball, resulting in a truer roll being implied to the ball at impact.

Applicant provides the novelty of using cavities open from the face of the club for the purpose of center-of-gravity management. The specific shaping of the cavities may be used to selectively distribute the weight, and thus manage the specific location of the center of gravity of the putter head. This allows significant improvement of the pre-impact stability of the club, as well as to improve the consistency of the path of the ball following impact, especially on off-center hits. Here, applicant uses the cavities to remove weight from the lower front portion of the putter head, at the extreme heel and toe areas, which resulting voids cause a shift of the center of gravity upward and to the rear of the putter head. When combined with a typical, hollow cavity to the rear of the central portion of the face of the club, a high moment of inertia is created.

Applicant's cavities may be left open, covered with a face plate or filled with epoxy resin or other low-density material. Given a typical putter head target weight of 300 to 350 grams, applicant can provide a putter head within a range such that a high moment of inertia is maintained for improved pre-impact stability and resistance to twist at impact (especially for off-center hits) while increasing the height of the center of gravity so that it is more in line with the center of mass of the golf ball.

SUMMARY OF THE INVENTION

Applicant provides a putter head for striking a golf ball, the putter having a shaft with a grip at one end (attached to a hosel) and with a putter head attached to the opposite end of the shaft. The putter head has a face, a sole, top surface, and back walls. The walls defining the face form cavities in the heel and toe areas which may be left open, covered with a face plate or filled with a low-density material.

BRIEF DESCRIPTION OF THE DRAWINGS

FIG. 4 is a rear elevational view of the putter head of applicant's present invention with the cavities ghosted in.

DETAILED DESCRIPTION OF THE PREFERRED EMBODIMENT

Figure 1:
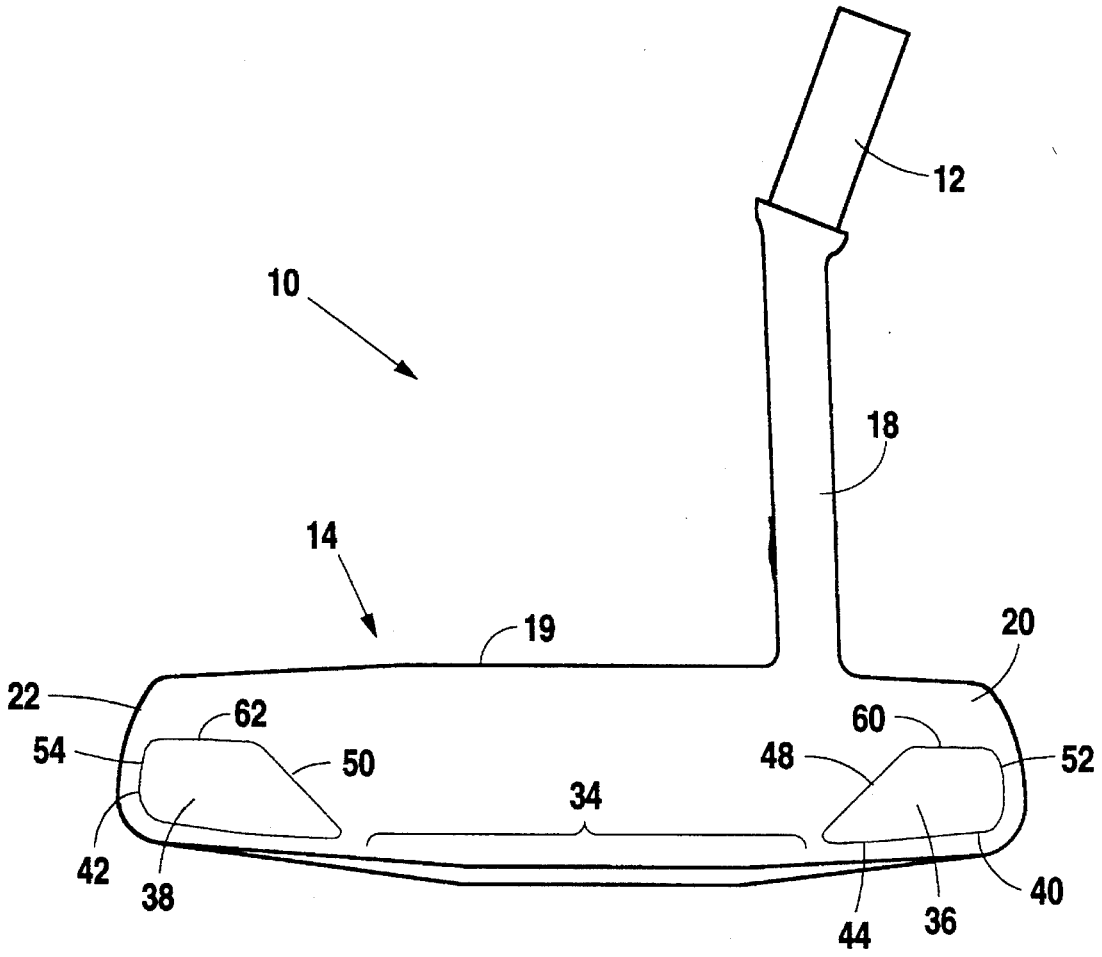
FIG. 1 is a front elevational view of the putter head of applicant's invention.
Figure 2:
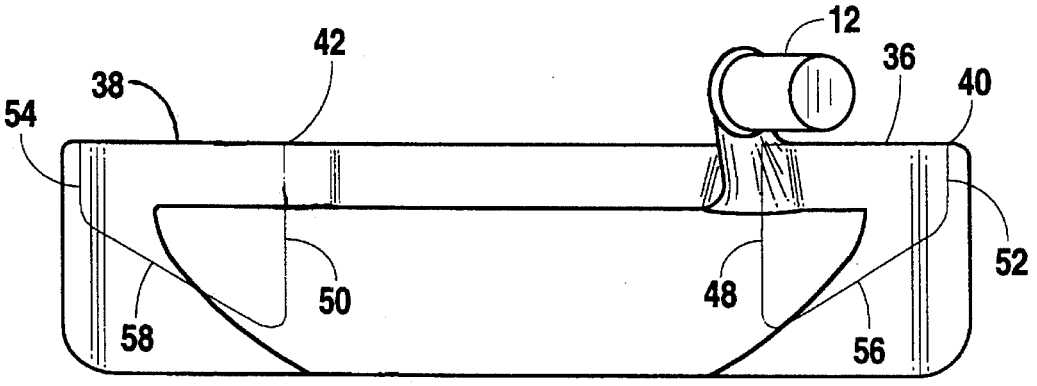
FIG. 2 is a top elevational view cut away through a horizontal mid-line plane of the putter head of applicant's present invention.
Figure 4:
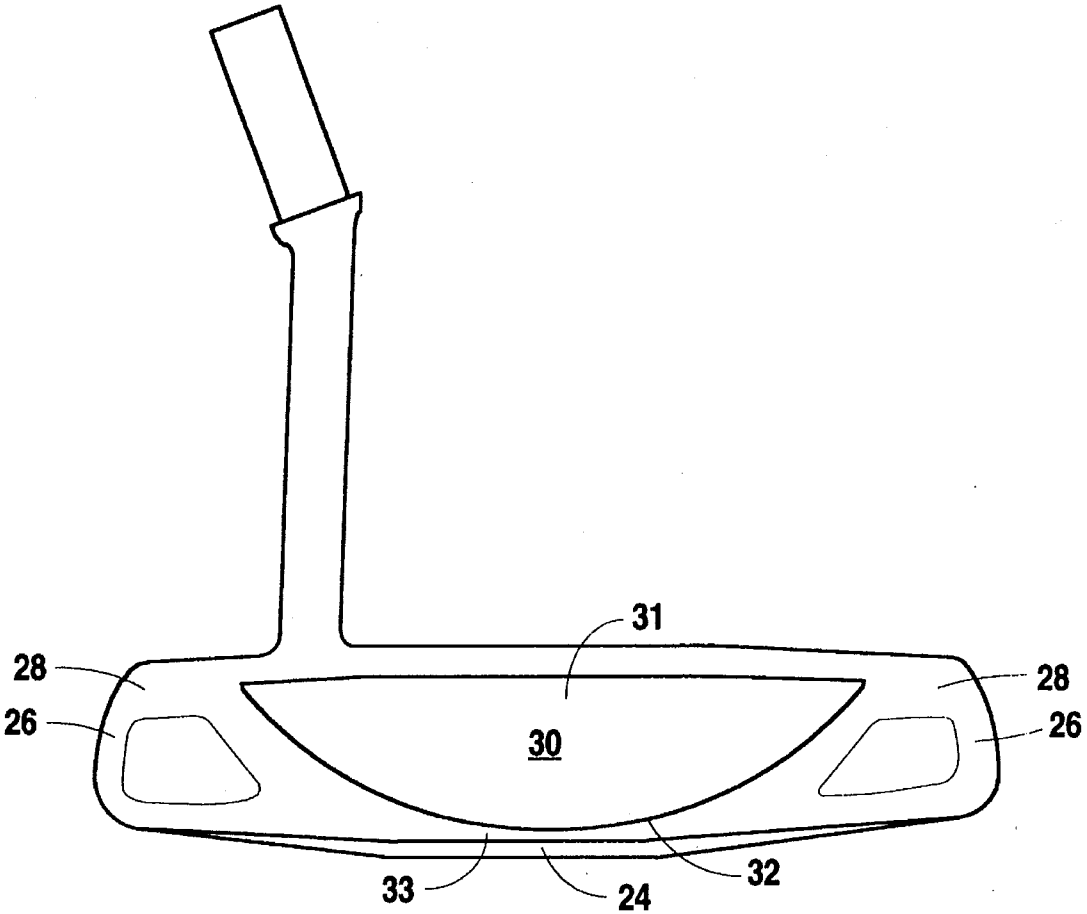
Figure 3:
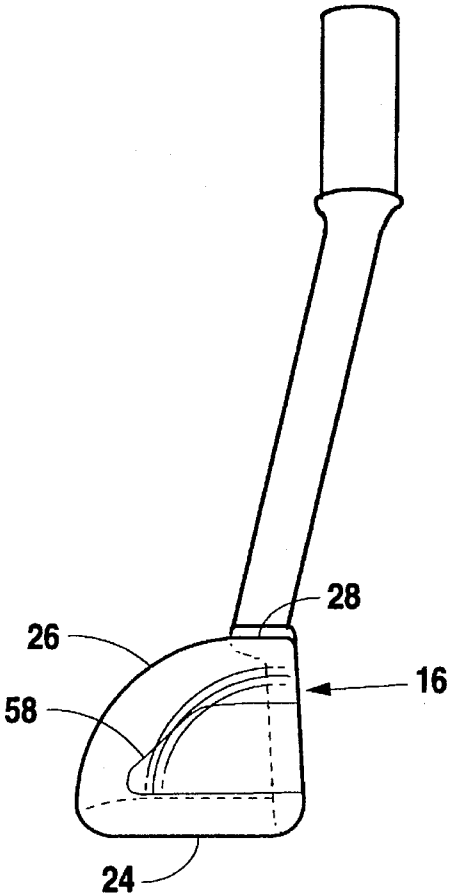
FIG. 3 is a side elevational view of a section of applicant's present invention through a cavity therein.

FIGS. 1 through 4 illustrate a putter (10) incorporating applicant's present invention. Putter (10) is comprised of an elongated straight shaft (12) attached to a putter head (14) having a face (16) thereof. Shaft (12) has a center line as illustrated in FIGS. 1, 3, and 4 as "CL". Note in FIG. 3 how hosel or shaft center line (18) is offset from face (16) a distance "bb" between an extension of CL through the hosel and face (16) of putter head (14). Face (16) has a slight positive loft illustrated by angle "L" (L being between 1 and 5 degrees). Putter head (14) has a heel area (20) and a toe area (22) at removed ends of face (16). Extending rearward from face (16) is a back wall (26) which has a top surface (28). Back wall (26) is excavated creating walls defining a rear face (30) and a rear floor (32), thereby concentrating putter head weight outboard and increasing the polar moment of inertia of the club head (14). With a rear cavity (31) defined by rear face (30) and rear floor (32), it is seen that the thickness of face (16) is greater at the heel (20) and toe (22) regions.

Turning now to FIG. 1, it is seen that a central portion (34) of face (16) is solid, no cavities opening to the front. In a rear view, central portion (34) is seen to define the region of excavation of rear cavity (31) defined by rear face (30) and rear floor (32). Removed from central portion (34) at both sides thereof, face (16) has a heel cavity (36) and a toe cavity (38), the cavities formed by walls extending into the putter head from face (16). Heel cavity (36) and toe cavity (38) are created by walls meeting face (16) at a heel cavity perimeter (40) and a toe cavity perimeter (42). From the shape and positions of the perimeters (40) and (42), it can be appreciated how weight distribution resulting from evacuation of cavities (36) and (38) tends to move the center of gravity up and toward the rear of putter head (14).

Turning now to the walls defined in the cavities themselves, it is seen that cavities (36) and (38) are defined in part by floors (44) and (46). Heel cavity (36) has a near side wall (48), and toe cavity (38) has a near side wall (50). Cavities (36) and (38) have far side walls (52) and (54), as well as top walls (60) and (62), respectively. Rear walls (56) and (58) complete the walls defining cavities (36) and (38), respectively.

FIG. 2 helps appreciate how applicant, sometimes by canting rear walls (56) and (58), has concentrated the weight of the putter head (14) in the extreme heel and toe regions, while at the same time moving the weight upward and toward the rear of the club. This weight distribution is accomplished by the applicant's unique means of providing cavities (36) and (38) open to the face.

Traditional wisdom has the face of the club sacred—meaning there is no excessive graphics or other defacement or marring of a smooth, uniform surface. By using rear cavity (31) combined with the novel face cavities (a "cavity back" design), the target weight of 300 to 350 grams may be achieved while concentrating weight in the heel and toe region, thus increasing the moment of inertia of the putter head while at the same time raising the center of gravity and moving it toward the rear of the club to increase the moment arm between axis K and the club face.

A flange or spine (33) is seen to run longitudinally across the rear of club face (16) defined as that portion between rear floor (32) and sole (24). Viewing putter head (14) in the illustration set forth in FIG. 2, it is seen that the thickness of club face (14) is uniform generally along most of central portion (34).

The putter head itself is typically fabricated from aluminum, brass, bronze, stainless steel, or the like. Cavities (36) and (38) can be left open, covered with a concealing plate, or filled with a low-density material, such as epoxy resin, a plastic polymer, aluminum, magnesium, or other lightweight metal. The target weight for the putter head is maintained by a combination of exterior styling and the use of cavities while providing the high moment of inertia to putter head (14), as well as a high center of gravity. This is accomplished by shaping cavities (36) and (38) such that the weight in the heel and toe sections is concentrated up and to the rear. The cavities may be left open, with the option of either covering or not covering them with face plates, such as ones made of aluminum, brass, stainless steel, or the like. If the cavities are filled with a low-density material such as set forth above, they may either be machined smooth with face (16) or covered with a face plate. Any combination of these treatments still results in the unique inertial balancing of applicant's putter head.

It is further appreciated with reference to FIGS. 1 and 3 that a plane horizontal to face (16) and through the mid-line between lower edge or sole (24) and upper edge (19) would show that the walls defining the heel and toe cavities are arranged such that the majority of the volume lies below that horizontal plane.

Terms such as "left," "right," "up", "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

I claim:

1. A putter for striking a golf ball, the putter comprising:

a shaft having a grip at a near end and a removed end;

a putter head, the putter head having a face, a sole, a top surface and a back wall; and walls defining a heel cavity and a toe cavity, said cavities open to the face of said putter head and filled with a low density material; said putter head further including walls defining an open cavity in said back wall wherein the majority of the volume defined by the walls of said cavities lies below a longitudinal axis extending horizontal to the face of said putter head and is located mid-line between the top surface and the sole, thereby raising the center of gravity of the putter head upwardly away from the sole and rearwardly away from the face of the putter head.

2. The device of claim 1, wherein said putter head is generally rectangular in shape.

3. The device of claim 1, wherein said putter head further includes a hosel.

4. The device as described in claim 1, wherein the putter head has a central portion of generally uniform thickness, the central portion comprising approximately two-thirds of the area of the face of the club, and wherein the walls defining the heel and toe cavities lie to either side of said central portion.

5. The device of claim 3, wherein the weight of the putter head and hosel, without shaft, is in the range of 300 to 350 grams.

6. The device of claim 1, wherein said material consists essentially of epoxy resin.

7. The device of claim 1 further comprising a single face plate for attachment flush to the face of said putter head.

8. The device of claim 1, wherein the putter head has a central portion of generally uniform thickness, the central portion comprising approximately two-thirds of the area of the face of the club, wherein the walls defining the heel and toe cavities lie to either side of said central portion, and wherein the weight of the putter head and hosel, without shaft, is in the range of 300 to 350 grams.

9. The device of claim 1, wherein the putter head has a central portion of generally uniform thickness, the central portion comprising approximately two-thirds of the area of the face of the club, wherein the walls defining the heel and toe cavities lie to either side of said central portion, wherein the weight of the putter head and hosel, without shaft, is in the range of 300 to 350 grams.

10. The device of claim 1, wherein the putter head has a central portion of generally uniform thickness, the central portion comprising approximately two-thirds of the area of the face of the club, wherein the walls defining the heel and toe cavities lie to either side of said central portion, wherein the weight of the putter head and hosel, without shaft, is in the range of 300 to 350 grams, wherein said heel and toe cavities are filled with epoxy resin.

11. A putter for striking a golf ball, the putter comprising:

a shaft having a grip at a near end and a removed end; and a putter head having a face, a sole, a top surface and a back wall, the putter head having walls defining a heel cavity and a toe cavity, said cavities opening to the face of the putter head and filled with a low density material; said putter head further including walls defining an open rear cavity in said back wall, the rear cavity laying between said toe and said heel cavities, thereby raising the center of gravity of the putter head upwardly away from the sole and rearwardly away from the face of the putter head.

12. The device of claim 11, wherein the majority of the volume defined by the walls of said toe and said heel cavities lies below the longitudinal plane of said putter head.

13. The device of claim 11, wherein the putter head has a central portion of generally uniform thickness, the central portion comprising approximately two-thirds of the area of the face of the club, and wherein the walls defining the heel and toe cavities lie to either side of said central portion.

14. The device of claim 11, wherein said putter head includes a hosel and wherein the weight of the putter head and hosel, without shaft, is in the range of 300 to 350 grams.

15. The device of claim 11, wherein said material is epoxy resin.

16. The device of claim 11 further comprising a face plate for attachment flush to the face of said putter head, thereby sealing said cavities.

17. A method for manufacturing a putter head, said method comprising:

providing a putter head having a face with wall-defining heel and toe cavities open to the face;

filling the heel and toe cavities with a low-density material to a point above the plane of the face of said putter head; and milling or otherwise finishing the face so that the filled cavities are flush with the face.

18. The method of claim 17 further comprising the steps of:

placing a face plate flush against the face; and attaching the face plate permanently thereto.

19. The method of claim 18 further comprising the steps of placing a concealing plate over each cavity, flush with the face.

* * * * *